US005820725A

United States Patent [19]

Maeda et al.

[11] Patent Number: 5,820,725

[45] Date of Patent: Oct. 13, 1998

[54] TAPE APPLICATION DEVICE

[75] Inventors: Tsuyoshi Maeda, Tokyo; Sigeyuki Yaguchi, Saitama, both of Japan

[73] Assignees: Lintec Corporation; Honda Motor Co., Ltd., both of Tokyo, Japan

[21] Appl. No.: 826,754

[22] Filed: Mar. 24, 1997

Related U.S. Application Data

[63] Continuation-in-part of Ser. No. 694,338, Aug. 8, 1996.

[30] Foreign Application Priority Data

Aug. 11, 1995 [JP] Japan ..... 7-205882
Dec. 18, 1996 [JP] Japan ..... 8-338232

[51] Int. Cl.[6] ..... B32B 31/00

[52] U.S. Cl. ..... 156/391; 156/523; 156/540; 156/579

[58] Field of Search ..... 156/391, 540, 156/579, 486, 479, 523, 574

[56] References Cited

U.S. PATENT DOCUMENTS

| | | | |
|---|---|---|---|
| 2,916,079 | 12/1959 | Schiefer | 156/391 |
| 3,935,758 | 2/1976 | Polzin et al. . | |
| 4,075,053 | 2/1978 | Adams . | |
| 4,617,073 | 10/1986 | Scott | 156/579 X |
| 4,818,329 | 4/1989 | Tutas et al. . | |
| 5,094,710 | 3/1992 | Sokolovsky | 156/579 X |
| 5,405,471 | 4/1995 | LeMaster | 156/579 X |

FOREIGN PATENT DOCUMENTS

| | | |
|---|---|---|
| 3834602 C2 | 7/1990 | Germany . |
| 51-135015 | 11/1976 | Japan . |
| 62-46780 | 2/1987 | Japan . |
| 2-221582 | 9/1990 | Japan . |
| 3-166068 | 7/1991 | Japan . |
| 5-65298 | 9/1993 | Japan . |
| 5-338627 | 12/1993 | Japan . |
| 2 238 339 | 5/1991 | United Kingdom . |
| 2 304 093 | 3/1997 | United Kingdom . |
| WO93/09050A1 | 5/1993 | WIPO . |

OTHER PUBLICATIONS

German Office Action of Application No. 196 32 268.5, Oct. 23, 1997 (English Translation).

Communication from the U.K. Patent Office Examiner of Oct. 10, 1996.

*Primary Examiner*—James Engel
*Attorney, Agent, or Firm*—Finnegan, Henderson, Farabow, Garrett & Dunner, L.L.P.

[57] ABSTRACT

A tape application device according to the present invention is designed for applying an adhesive tape on a tape applying surface formed on a work. The tape application device includes a main body having a gripping portion, a tape guide portion provided in the main body and having a pressing portion for pressing the adhesive tape onto the tape applying surface, and engaging means for slidably pressing the pressing portion onto the tape applying surface. The engaging means includes first engaging portion having a sliding block held slidably with respect to a holder block provided in the main body, and a first contact portion provided in the sliding block and releasably contacting with the work and second engaging portion provided on the main body in opposition to the first engaging portion across the tape guide portion and having a second engaging portion with a second contact portion contacting with the work. The tape application device can apply the adhesive tape at a predetermined position of the left and right door sash portions, and also the applying operation can be done easily and quickly.

20 Claims, 15 Drawing Sheets

TAPE APPLICATION DEVICE

This application is a Continuation-in-part Application of U.S. patent application Ser. No. 08/694,338 filed on Aug. 8, 1996.

BACKGROUND OF THE INVENTION

Field of the Invention

The present invention relates to a tape application device peeling a strip form adhesive tape off a released paper and applying the adhesive tape on a tape applying surface formed on a work.

It is desirable to provide delustering black coating on the interior side of a door sash of an automotive vehicle, in view of the following reason. Namely, as viewed from the outside of the vehicle, particularly from the side of a vehicle body, clear external appearance of a overall vehicle body can be certainly provided by restricting reflection of a light at the interior side of the door sash.

For this purpose, it has been conventionally performed to perform spray painting of delustering black paint on the door sash portion. However, spray painting encounters various problems as requiring investment for additional facility for maintaining work environment good enough, taking a long period for drying paint, and so forth. As a solution for such drawback, Japanese Patent Application Laying-open No. 135015/1976 or Japanese Patent Application Laying-open No. 46780/1987 proposes application of delustering black adhesive tape having high weather resistance and high wear resistance on a door sash portion, in place. In such case, as is well known, since the most part of the door sash portion of an automotive vehicle is consisted of three-dimensional curved portion, the above-mentioned adhesive tape application apparatus inherently becomes large scale. Also, when such adhesive tape application apparatus is installed in a practical production line, an investment for production line becomes huge. In addition, it has poor flexibility in adapting to modification of design of the door sash portion, and has poor general-purpose properties.

It can be considered that the operation for application of the adhesive tape is performed manually by the worker without using any device. However, in order to accurately perform applying operation at a speed adapted to the production line of the automotive vehicle, quite high skill is required.

Thus, there has been proposed in Japanese Patent Application Laying-open No. 338627/1993, a tape application device which can easily and quickly perform application of the adhesive tape without requiring high skill of the worker. By employing the tape application device, the adhesive tape can be accurately applied at a predetermined position of the door sash portion easily and quickly without requiring high skill of the worker. In addition, a device for automatically assembling a weatherstrip to a door sash portion, such as those disclosed in Japanese Patent Application Laying-Open No. 221582/1990, Japanese Patent Application Laying-Open No. 166068/1991 or Japanese Patent Application Publication No. 65298/1993, may also be applicable.

In the conventional tape application device, disclosed in Japanese Patent Application Laying-open No. 338627/1993, there are right-cut device and left-cut device adapting to a right side door and a left side door of the automotive vehicle. Therefore, in case of sedan type passenger vehicle, for example, four kinds of tape application device respectively for a left front door, a left rear door, a right front door and a right rear door have to be used selectively to make tape applying operation complicate and troublesome.

Also, when shape, such as width of the door sash portion and so forth in one model of the vehicle is modified, the tape application device adapted to the modified shape has to be prepared at every occasion. Namely, the conventional tape application device has quite poor flexibility in adapting to modification of the shape of the tape applying surface.

On the other hand, when the weatherstrip installation device, such as those disclosed in Japanese Patent Application Laying-Open No. 221582/1990, Japanese Patent Application Laying-Open No. 166068/1991 or Japanese Patent Application Publication No. 65298/1993 are converted over the tape application device, a space for setting up a manipulator in addition to a holding and positioning device of a door panel. Therefore, it becomes not possible to adapt to such requirement unless a manufacturing line of the automotive vehicle is modified.

SUMMARY OF THE INVENTION

Therefore, it is an object of the present invention to provide a tape application device which has high flexibility in adapting to the shape of tape applying surfaces and thus permits accurate application of an adhesive tape at predetermined positions on left and right door sash portions, easily and quickly without requiring highly skilled worker.

According to first aspect of the invention, a tape application device for applying a strip form adhesive tape along a tape applying surface formed on a work with peeling the adhesive tape from a strippable sheet, comprises:

a main body having a gripping portion;

a tape guide portion provided in the main body and having a pressing portion for pressing the adhesive tape onto the tape applying surface; and engaging means for slidably pressing the pressing portion onto the tape applying surface, the engaging means including:

first engaging portion having a sliding block held slidably with respect to a holder block provided in the main body, and a first contact portion provided in the sliding block and releasably contacting with the work; and second engaging portion provided on the main body in opposition to the first engaging portion across the tape guide portion and having a second engaging portion with a second contact portion contacting with the work.

Here, it is possible to provide a plurality of the second contact portions with a given interval along a guiding direction of the adhesive tape by the tape guide portion. Hereby, the tape application device can engage with the work without play.

The second contact portion is a claw member supported on the main body, and the device further comprises position adjusting means for adjusting position of the second contact portion in opposing direction to the first contact portion. Hereby, even when the width of the work is differentiated significantly, the main body can be engaged to the work without play, by appropriately varying distance between the claw member and the first contact portion through operation of the position adjusting means.

The pressing portion may be formed in projecting condition at least at a center portion of the tape guide portion, in elastically deformable fashion.

The slide block may be slidable in opposing direction of the first engaging portion and the second engaging portion. In this case, biasing means for biasing the first engaging portion toward the second engaging portion may be provided between the main body and the slide block. Hereby, the main body can be constantly engaged with the work by moving the first contact portion in the opposing direction to the second contact portion according to variation of the width of the work and variation of configuration.

The surface of the pressing portion is coated with a member having low friction coefficient. In this case, a frictional resistance upon moving the main body along the tape applying surface of the work can be reduced.

It is preferred that the gripping portion extends in a direction perpendicular to a guiding direction of the adhesive tape by the tape guide portion with a clearance relative to the pressing portion. In this case, the adhesive tape and the released paper before peeling may pass through a clearance defined between the gripping portion and the tape guide portion. Hereby, when the adhesive tape is peeled from the released paper and turned over the tape guide portion, only released paper is positioned at the front side of the moving direction of the main body.

In the present invention, the distal end of the adhesive tape is affixed to the predetermined position of the tape applying surface of the work. Next, the first contact portion and the second contact portion of the engaging means contact with the work so that the tape guide portion of the main body may overlap with the portion of the tape applying surface where the distal end of the adhesive tape is affixed. Hereby, the adhesive tape is held pressed onto the tape applying surface by the pressing portion.

At this condition, the main body moves along the tape applying surface. The adhesive tape restricted offset with respect to the tape applying surface by the tape guide portion, is pressed onto the tape applying surface with causing elastic deformation of the pressing portion, and progressively affixed to the tape applying surface according to movement of the main body.

It should be noted that when the direction to pass the adhesive tape is reversed with respect to the tape guide portion of the main body, the main body is moved in reverse direction with respect to the tape applying surface of the work.

According to the second aspect of the invention, a tape application device for applying an adhesive tape on a tape applying surface formed on a work, comprising:

a main body having a gripping portion;

a tape guide portion provided in the main body and having a pressing portion for pressing the adhesive tape onto the tape applying surface;

engaging means for slidably pressing the pressing portion onto the tape applying surface; and projecting and retracting means for projecting and retracting the pressing portion along pressing direction;

the engaging means including first engaging portion having a sliding block held slidably with respect to a holder block provided in the main body, and a first contact portion provided in the sliding block and releasably contacting with the work; and second engaging portion provided on the main body in opposition to the first engaging portion across the tape guide portion and having a second engaging portion with a second contact portion contacting with the work.

Here, the first contact portion may be a roller rotatably supported with respect to the slide block. Similarly, the second contact portion may be a roller rotatably supported with respect to the main body. Hereby, resistance upon movement of the tape application device with respect to the work can be reduced.

On the other hand, it is possible to arrange a plurality of second contact portions with a given interval along guiding direction of the adhesive tape by the tape guide portion. Hereby, the tape application device can engage with the work without play.

Furthermore, it is effective to form the surface of the pressing portion with a rubber-like elastic body. Hereby, it is possible to apply evenly the adhesive tape on the tape applying surface.

On the other hand, the slide block may be slidable in opposing direction of the first engaging portion and the second engaging portion. Hereby, when the sliding block slides so that the first engaging portion moves away from the second engaging portion, it becomes possible to attach and detach the tape application device to and from the work. In this case, it is preferred that biasing means for biasing the first engaging portion toward the second engaging portion is provided between the main body and the slide block. Hereby, the tape applying device can be automatically placed in engaged condition to the work.

The projecting and retracting means may be associated with the sliding block for operation according to sliding operation of the latter. In this case, the projecting and retracting means may include a stepped shaft having a larger diameter portion at a proximal end portion connected to the slide block and a smaller diameter portion at a distal end portion connected to the larger diameter portion via a tapered position, and a holding pin arranged coaxially with the stepped shaft and supported on the main body at a proximal end thereof, the distal end of the support pin is slidably engaged with the stepped shaft from the smaller diameter portion side, and the pressing portion may have a stepped bore corresponding to the stepped shaft and is rotatably supported on the stepped shaft.

Namely, when the slide block slides to shift the first engaging portion away from the second engaging portion, the pressing portion moves way from the tape applying surface of the work by own weight. Hereby, the larger diameter bore portion of the pressing portion corresponding to the large diameter portion of the stepped shaft is supported by the smaller diameter portion of the stepped shaft, and the smaller diameter bore portion of the pressing portion corresponding to the smaller diameter portion of the stepped shaft is supported by the support pin. Conversely, when the slide block slides so that the first engaging portion moves toward the second engaging portion, the pressing portion projects for pressure contact with the tape applying surface of the work against own weight. Hereby, the larger diameter bore portion of the pressing portion is supported by the larger diameter portion of the stepped shaft and the smaller diameter bore portion of the pressing portion is supported by the smaller diameter portion of the stepped shaft. In this case, a difference of diameters between the larger diameter portion and the smaller diameter portion of the stepped shaft and a difference of diameters between the smaller diameter portion of the stepped shaft and the support pin may be set substantially equal to each other. Hereby, the pressing portion may project and retract in parallel to the axis of the stepped shaft.

The gripping portion preferably extends in a direction perpendicular to a guiding direction of the adhesive tape by the tape guide portion with a clearance relative to the pressing portion. In this case, the adhesive tape and the released paper before peeling may pass through a clearance between the gripping portion and the tape guide portion. Hereby, when the adhesive tape is peeled from the released paper and turned over the tape guide portion, only released paper is positioned at the front side of the moving direction of the main body.

In the present invention, the distal end portion of the adhesive tape is applied to the predetermined position of the tape applying surface of the work. Next, the first contact portion and the second contact portion of the engaging means contact with the work so that the tape guide portion of the main body may overlap with the portion of the tape applying surface where the distal end of the adhesive tape is affixed. Hereby, the adhesive tape is pressed with elastic deformation of the pressing portion onto the tape applying surface.

At this condition, the main body is moved along the tape applying surface. The adhesive tape restricted offset with respect to the tape applying surface by the tape guide portion, is pressed onto the tape applying surface with elastic deformation of the pressing portion, and progressively affixed to the tape applying surface according to movement of the main body.

In the case where the tape application device is removed from the work, the slide block is operated to release the first contact portion from the work. Then, the projecting and retracting means moves the pressing portion away from the tape applying surface of the work. Thus, the tape application device is removed from the work.

According to the tape application device of the present invention, the direction to pass the adhesive tape has no directionality relative to the tape guide portion of the main body. Namely, along the longitudinal direction of the adhesive tape, the adhesive tape can pass the tape guide portion in either direction. Therefore, the device can be used in either of left-cut and right-cut works.

On the other hand, by mounting the slide block slidably in opposing direction of the first and second engaging portions, and providing the biasing means for biasing the first engaging portion toward the second engaging portion, between the main body and the slide block, the first contact portion is displaced in opposing direction to the second contact portion following variation of the width of the work and variation of configuration to constantly engage the main body with the work without play. As a result, without requiring skilled worker, the adhesive tape can accurately affix on the tape applying surface of the work. In addition, adapting ability to variation of configuration of the work becomes superior that the conventional one.

In the case where the surface of the pressing portion is coated with a member having low friction coefficient, a frictional resistance upon moving the main body along the tape applying surface of the work can be reduced, and tape applying operation can be done easily with smaller moving force.

In the case where the first and second contact portions are formed by rollers, resistance upon movement of the tape applying device can be reduced. As a result, tape application work can be done easily with small operation force. Furthermore, in the case where a plurality of second contact portions are arranged along guiding direction of the adhesive tape by the tape guiding portion, the tape application device can engage with the work without any play. Therefore, the adhesive tape can be affixed on the tape applying surface of the work precisely.

In the case where the surface of the pressing portion is formed with the rubber-like elastic body, the adhesive tape is applied to the tape applying surface with irregularity preventing admixing of the air bubble. In addition, in the case where the projecting and retracting means is associated with operation of the slide block, the tape application device can be easily attached and detached to and from the work.

In the case where a gripping portion for gripping the main body is provided at the opposite side of the tape receiving portion, and a portion is extended from the gripping portion in parallel to the direction perpendicular to the longitudinal direction of the take applying surface with defining a clearance together with the tape receiving portion, the adhesive tape and the released paper before peeling passes through the clearance between the gripping portion and the tape receiving portion, and turns over the tape receiving portion with peeling off the adhesive tape. Therefore, only released paper is positioned in the front side of the moving direction of the main body to improve workability.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention but are for explanation and understanding only.

In the drawings.

DETAILED DESCRIPTION OF THE PREFERRED EMBODIMENT

Figure 1:
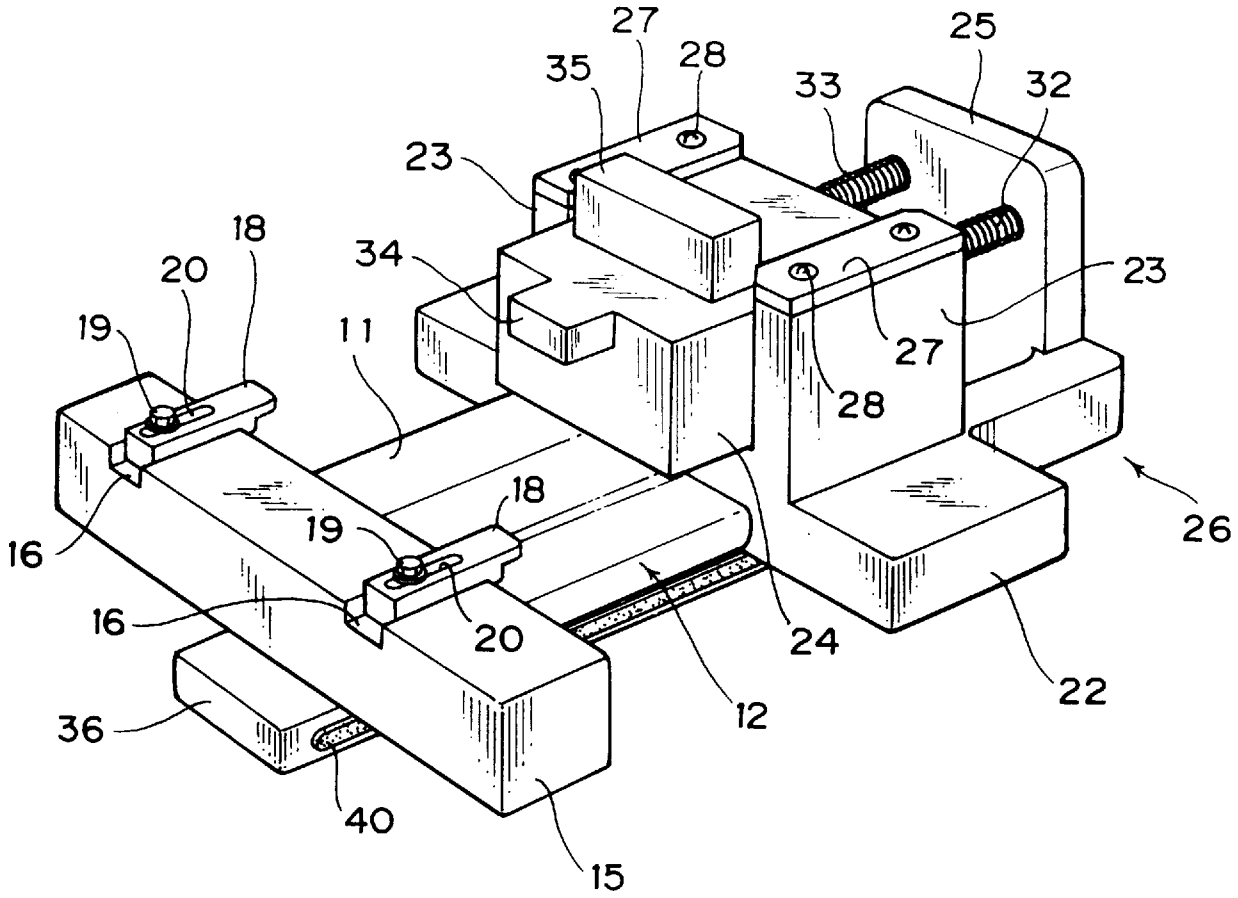
FIG. 1 is a perspective view showing an external appearance of one embodiment of a tape application device according to the present invention as applied for a front door inner sash portion of a passenger vehicle.
Figure 2:
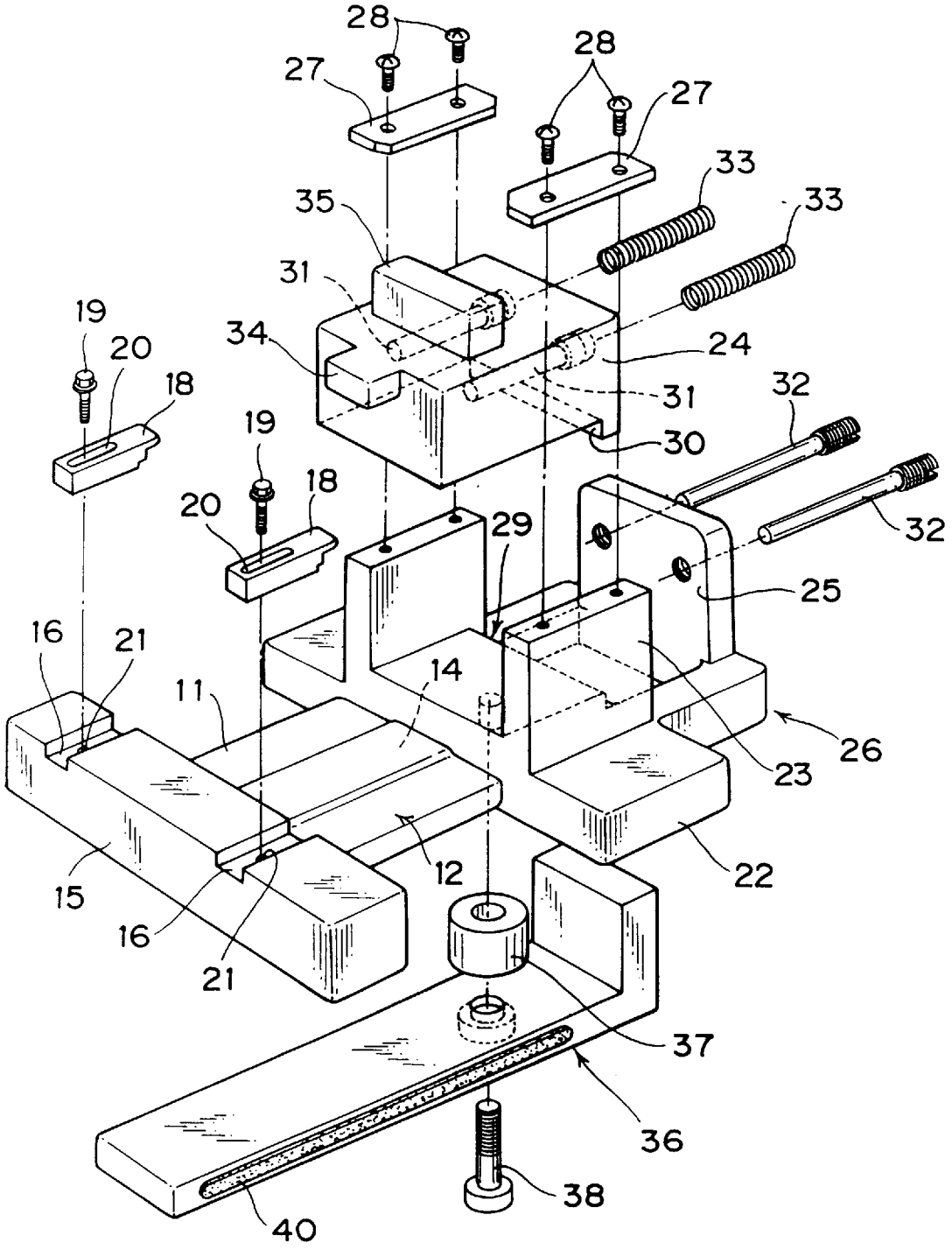
FIG. 2 is an exploded perspective view of the embodiment shown in FIG. 1.
Figure 3:
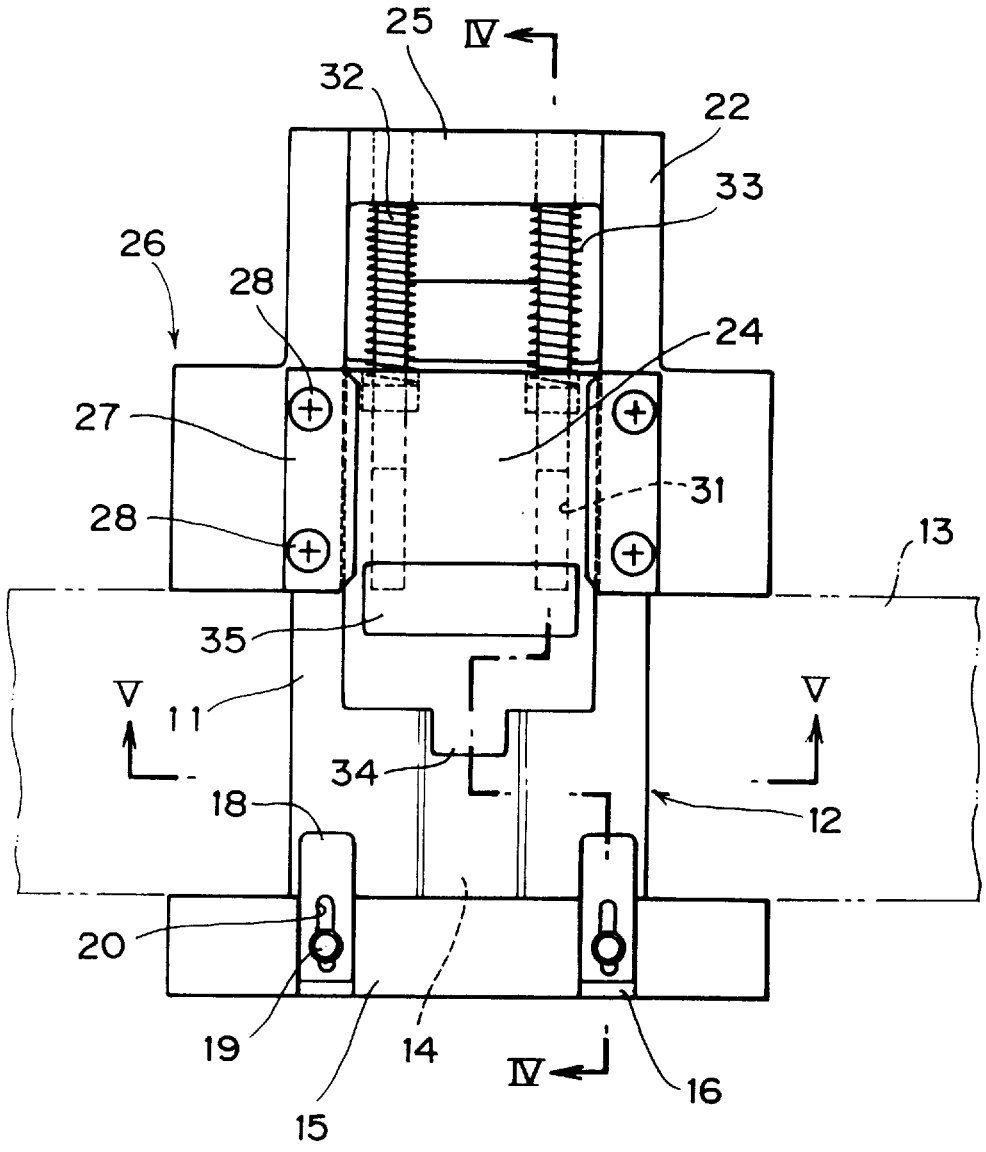
FIG. 3 is a plan view of the embodiment shown in FIG. 1.
Figure 4:
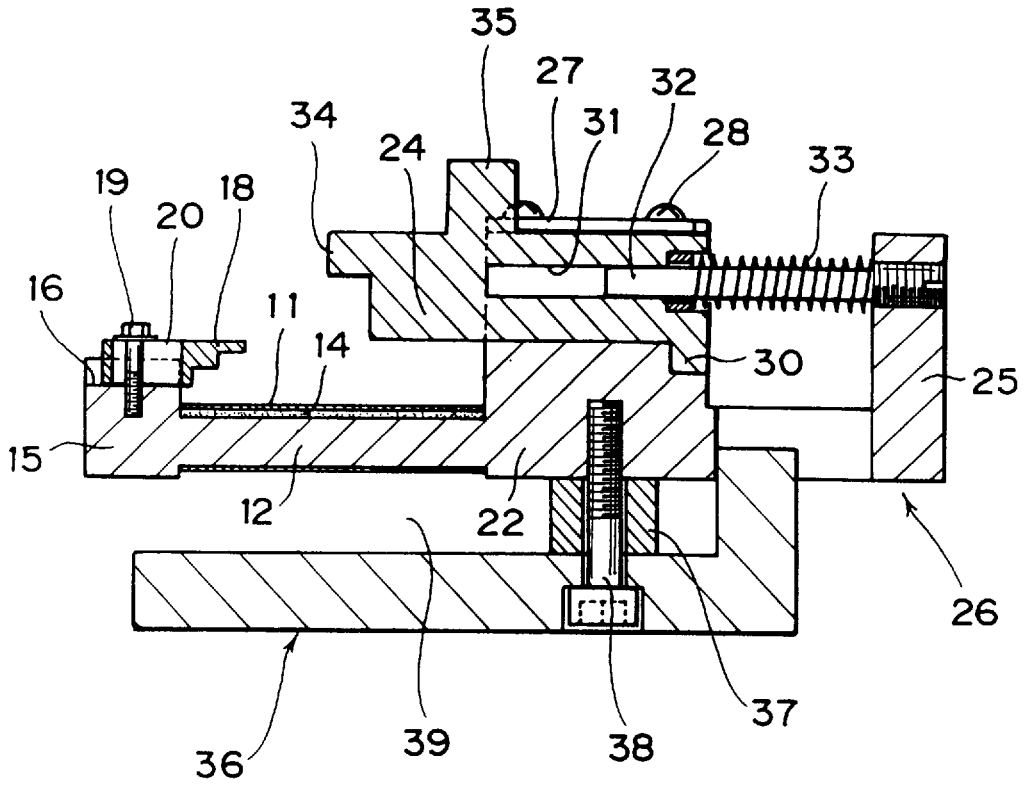
FIG. 4 is a section taken along line IV—IV of FIG. 3.
Figure 5:
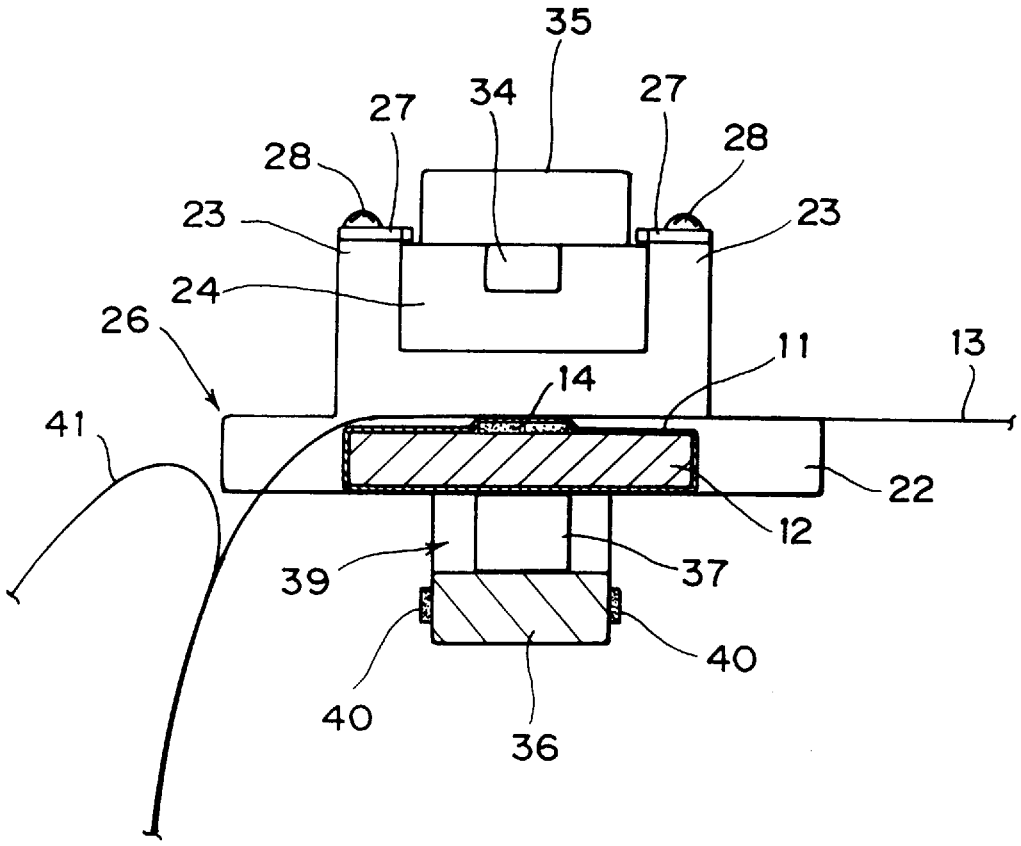
FIG. 5 is a section taken along line V—V of FIG. 3.
Figure 6:
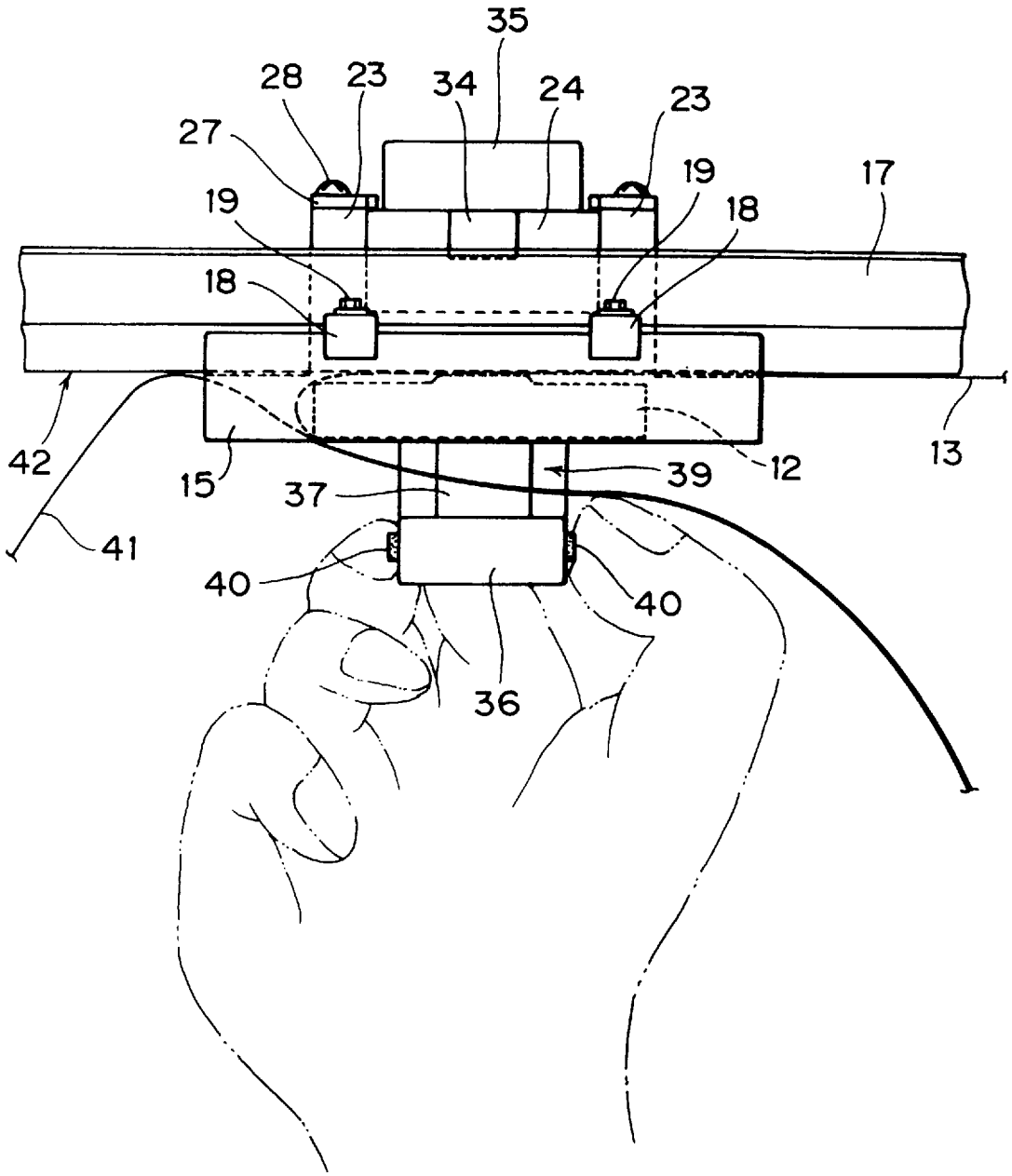
FIG. 6 is a front elevation of one embodiment of the tape application device shown in FIG. 1, in which the tape application device is coupled with the front door sash portion.
Figure 7:
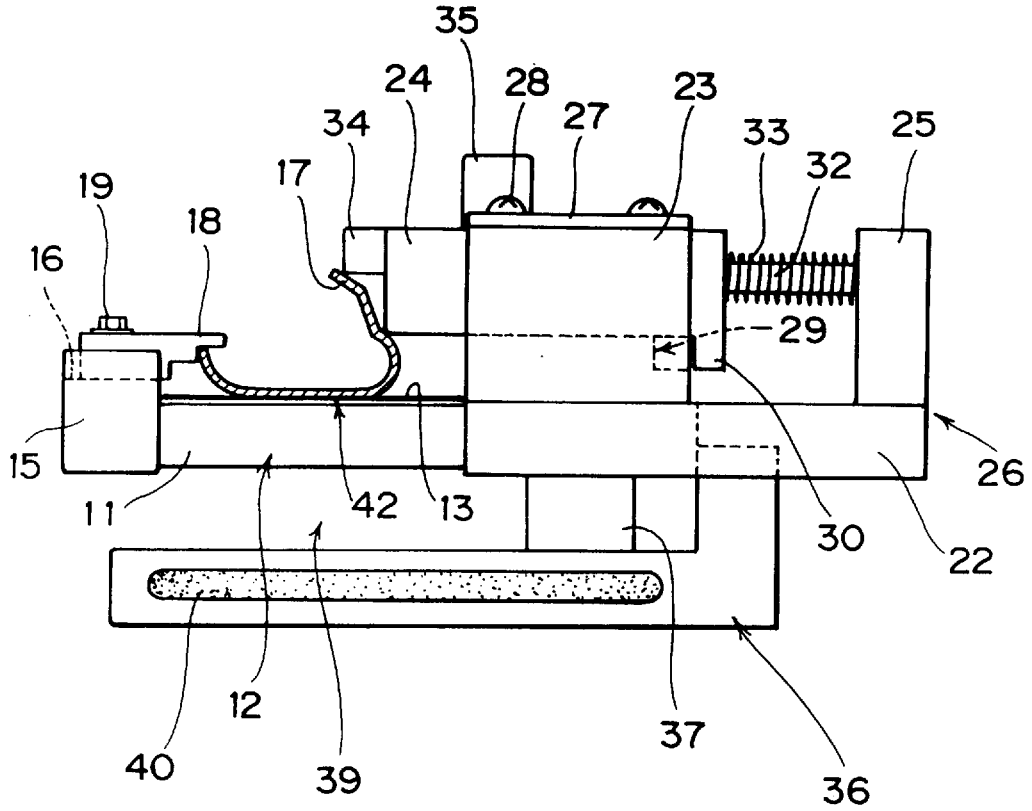
FIG. 7 is a left side elevation of one embodiment of the tape application device shown in FIG. 1, in which the tape application device is coupled with the front door sash portion.
Figure 8:
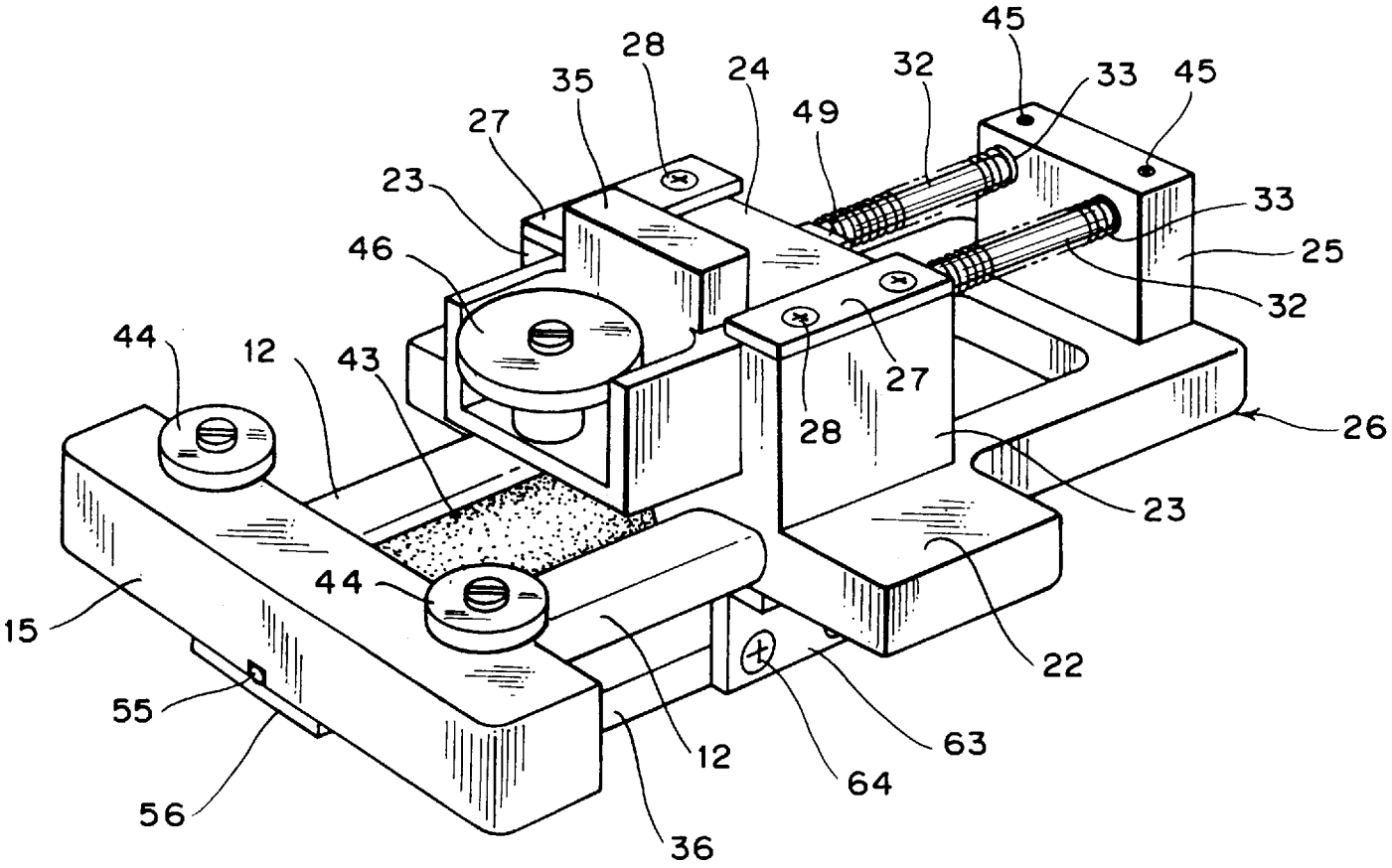
FIG. 8 is a perspective view showing external appearance of another embodiment of the tape application device according to the invention.
Figure 9:
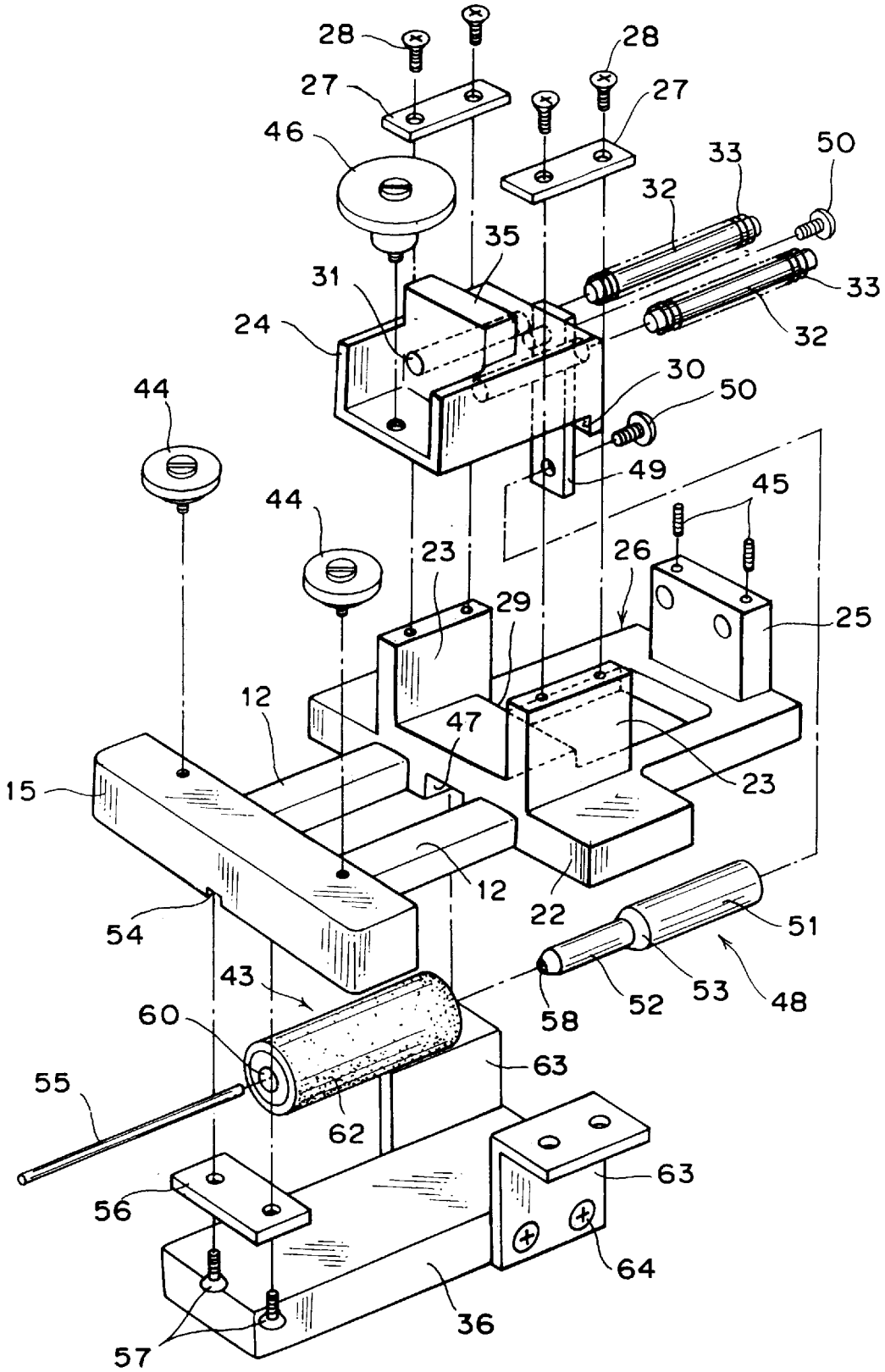
FIG. 9 is an exploded perspective view of the embodiment shown in FIG. 8.
Figure 10:
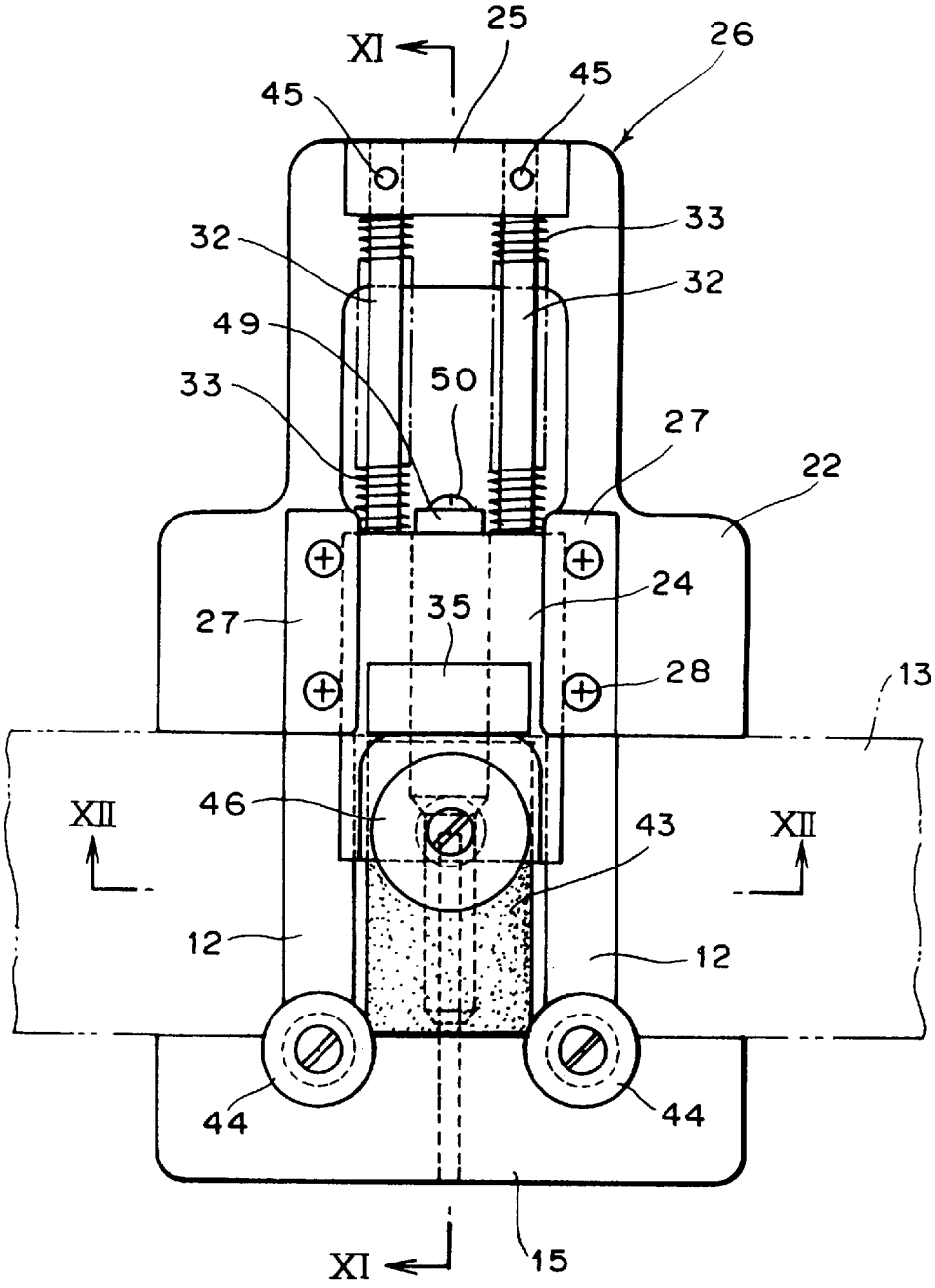
FIG. 10 is a plan view of the embodiment shown in FIG. 8.

The present invention will be discussed hereinafter in detail in terms of the preferred embodiment of a tape application device as applied for a front door sash portion of a passenger vehicle, with reference to FIG. 1 showing an external appearance, showing in exploded condition, FIG. 3 showing a plan view, FIGS. 4 and 5 respectively showing sections taken along line IV—IV and line V—V, FIG. 6 showing a front elevation in a condition connected to a front door sash portion, and FIG. 7 is a left side elevation thereof. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Namely, a flat plate form tape guide portion 12 which is coated with a member 11 of low friction coefficient, such as high density polyethylene sheet and so forth, has a width matching with a width (vertical length in FIG. 3) of an adhesive tape 13. At the center portion of the tape guide portion 12 along the longitudinal direction (left and right direction in FIG. 3) of the adhesive tape 13, an elastically deformable tape pushing sheet 14 which is formed of a foamed polyurethane sheet or so forth is affixed in projected condition as a tape pushing means of the present invention. The tape pushing sheet 14 is in a condition coated by the member 11 of low friction coefficient set forth above.

On one edge of the tape guide portion 12 in width direction, an end block 15 contacting with one of side edges of the adhesive tape 15 is formed integrally. On the end block 15, a pair of side grooves 16 extending in parallel to each other are formed along width direction of the tape guide portion 12. In these pair of grooves 16, claw members 18 engageable with outer side of a front door sash portion 17 are fixed to the end block 15 by fastening bolts 19 as second engaging portion of the present invention. The distal ends of the claw members 18, which serve as second contact portion of the present invention, is projected right above one end side of the tape guide portion 12.

In the shown embodiment, an elongated hole 20 is formed through the claw member 18 for extending the fastening bolt 19 therethrough, and a female thread bore 21 is formed in the bottom of the groove 16. Hereby, depending upon difference of dimensions of the front door sash portion 17 in the width direction, the projecting position of the claw member 18 can be varied. These fastening bolt 19, the elongated hole 20 and the female thread bore 21 form a position adjusting means of the present invention.

On the other end of the tape guide portion 12 in width direction, a holder block 22 contacting with the other side edge of the adhesive tape 13, is formed integrally in opposition to the end block 15. On the holder block 22, a pair of front and rear guide walls 23 are extended in mutually parallel relationship to each other. Between these guide walls 23, a rectangular slide block 24 is disposed for sliding movement in a direction toward and away from the claw member 18. Also, at the end of the holder block 22 opposite to the side where the tape guide portion 12 is located, a guide bar holder 25 opposing to the slide block 24 is extended vertically.

It should be noted that a main body 26 in the shown embodiment is constructed with the end block 15, the holder block 22, the guide wall portion 23 and the guide bar holder 25.

At the upper end of the guide wall portion 23, a retainer plate 27 preventing the slide block 24 from upwardly loosing off from the guide wall portion 23, is secured by means of fastening screws 28. On the other hand, at the guide bar holder 25 side of the slide block 24, a stopper portion 30 preventing the slide block from loosing off toward the end block 15 side by engaging with a stepped portion 29 formed at the center portion of the holder block 22, is extended downwardly. Furthermore, in the guide bar holder 25, proximal end portions of a pair of guide bars 32, distal end portions of which are slidably engaged with a pair of guide holes 31 formed in the slide block 24 in mutually parallel relationship along the width direction of the tape guide portion, are secured by means of screws. On these guide bars 32, a compression coil spring 33 is wound around at a position between the slide block 24 and the guide bar holder 25 for biasing the slide block 24 toward the end block 15.

Accordingly, the slide block 24 is biased toward the end block 15 by the spring force of the compression coil spring 33. Then, the slide block 24 may be moved toward the guide bar holder 25 against the spring force of the compression coil spring 33.

On the end face of the slide block 24 at the end block 15 side, a projecting portion 34 which can engage with the inner side of the front door sash portion 17 and are cooperated with a pair of claw members 18 to be secured on the front door sash portion 17. The distal end portion of the projecting portion 34 serves as a first contact portion of the present invention. By the claw members 18 and the projecting portion 34, the main body 26 can be secured on the front door sash portion 17. Furthermore, on the upper end of the slide block 24, a finger grip portion 35 for retracting the slide block 24 toward the guide bar holder 25 against the spring force of the compression coil spring 33, is extended upwardly.

At the center portion of the holder block 22, a proximal end portion of an L-shaped handle portion 36 extending in the width direction of the tape guide portion 12, is secured via a spacer 37 by means of a fastening bolt 38. Between the handle portion 36 and the tape guide portion 12, a gap 39 is formed. At both end faces of the handle portion 36, a slide stop rubber 40 is affixed.

Accordingly, upon practical operation, the distal end portion of the adhesive tape 13 is peeled off from a released paper 41. Then, the distal end portion of the adhesive tape 13 is applied to the predetermined position (generally, application start position) of a flat tape applying surface 42 of the front door sash portion 17. Thereafter, utilizing the fiber grip portion 35, the slide block 24 is peeled off from the claw members 18. Then, with maintaining this condition, in order to overlap the tape guide portion 12 of the main body 26 and a portion of a tape applying surface 42, on which the distal end portion of the adhesive tape is affixed, the main body 26 is pressed onto the front door sash portion 17. Then, releasing the finger grip portion 35, by a spring force of the compression spring 33, the claw members 18 and the projecting portion 34 are engaged to the front door sash portion 17. Hereby, the tape pushing sheet 14 is crushed by elastic deformation to place the adhesive tape 13 pressed onto the tape applying surface 42.

At this condition, with peeling off the adhesive tape 14 from the released paper 41, the main body 26 is moved toward left in FIG. 6 along the tape applying surface 42. By the tape guide portion 12, the adhesive tape 13 which is restricted the offset relative to the tape applying surface, is pressed onto the tape applying surface 42 associating with elastic deformation of the tape pushing sheet 14, and thus affixed onto the tape applying surface 42.

Here, the slide block 24 is constantly biased toward a pair of claw members 18 by the spring force of the compassion spring 33. Therefore, following to fluctuation or variation of width of the front door sash portion 17, the slide block 24 is moved toward and away from the claw members 18. In this result, with respect to the front door sash portion 17, the main body 26 is engaged to the front door sash portion 17 relative to the claw members 18, without play. On the other hand, since the surfaces of the tape guide portion 12 and the tape pushing sheet 14 are coated with the member of low friction coefficient, a frictional resistance when the main body 26 is moved along the tape applying surface of the front door sash portion 17, becomes small to facilitate operation.

Thus, the adhesive tape 13 is applied on the tape applying surface 42 of the front door sash portion 17. Then, by employing a not shown squeezing roller, both end portions of the adhesive tape 13 in width direction is applied to the remaining portion of the front door sash portion 17. At this condition, since the position of the adhesive tape 13 relative to the front door sash portion 17 is already determined, operation can be easily without any problem.

It should be noted that the adhesive tape 13 and the released paper 41 may be placed at the front side in the forward direction, as shown in FIG. 5. In this case, as shown in FIG. 6, by turning the adhesive tape 13 around the tape guide portion 12 through a gap 39 between the handle portion 36 and the tape guide portion 12, the released paper 41 is placed at the front side of the moving direction of the main body 26 to effectively improve operability.

On the other hand, the left and right front door sash portions 17 set forth above, are normally formed symmetrically relative to the body of the automotive vehicle. Depending upon left- and right-cut, the direction to pass the adhesive tape 13 relative to the tape guide portion 12 is reversed from the condition shown in FIGS. 5 and 6, and the main body 26 relative to the tape applying surface 42 of the front door sash portion 17 is moved in the reversed direction. Then, the main body can be used as is.

Furthermore, when the width and configuration of the front door sash portion 17 due to difference of the kind of vehicle is differentiated significantly, by loosing the fastening bolt 19 to appropriately moving the positions of the claw members 18 and exchanging the claw members 18 and the slide block 24 to those of other configuration, the main body can be adjusted and matched thereto.

While the pressing portion is fixed to the main body in the embodiment set forth above, it is possible to construct for projecting and retracting. Another embodiment of the tape application device of such invention will be described in detail with reference to FIGS. 8 to 15. It should be noted that the elements having the same function to the former embodiment will be identified by the same reference numerals.

Namely, the end block 15 contacting with one side end face of the adhesive tape 13 and the holder block 22 contacting with the other side end face of the adhesive tape 13 are integrally coupled via a pair of tape guide portions 12 extending in parallel to each other. Namely, a pair of tape guide portions 12 have lengths corresponding to width of (length in vertical direction in FIG. 10) of the adhesive tape 13. The surfaces of these tape guide portions are coated with members 11 having low friction coefficient, such as high density polyethylene sheet. On the other hand, between a pair of the tape guide portions 12, a pressure drum 43 is arranged as pressing portion of the present invention. A support structure of the pressure drum 43 will be explained later.

On the end block 15, a pair of positioning rollers 44 engageable with the outer side of the front door sash portion 17, are mounted rotatably. Part of the outer peripheral portions of the positioning rollers 44 are projected right above the front end side (lower side in FIG. 10) of the tape guide portion 12. A pair of positioning rollers 44 serve as second engaging portion having the second contact portion of the present invention. The positioning rollers 44 can be exchanged to those of optimal dimension and configuration depending upon a dimension in the width direction and configuration of the front door sash portion 17.

On the holder block 22 set forth above, a pair of guide wall portions 23 are provided vertically in parallel relationship to each other. Between these guide wall portions 23, the slide block 24 is slidably received for sliding in the opposing direction to the positioning rollers 44. Also, at the end portion of the holder block 22 at the opposite side of the tape guide portion 12, the guide bar holder 25 is provided to extend vertically. The guide bar holder 25 opposes to the slide block 24.

It should be noted that the main body 26 in the shown embodiment is constructed with the foregoing end block 15, the holder block 22, the guide wall portion 23, the guide bar holder 25 and also a gripping portion 36 and the like.

At the upper end of the guide wall portion 23, the holding plates 27 are fixed via respective fastening screws 28. These holding plates 27 serves for preventing the slide block 24 from loosing off the guide wall portion 23 in upward direction. On the other hand, at the guide bar holder 25 side of the slide block 24, a stopper portion 30 is projected downwardly. The stopper portion 30 engages with a stepped portion 29 formed at the center portion of the holder block 22. Thus, loosing off of the slide block 24 to the end block 15 side is successfully prevented. Also, in the guide bar holder 25, proximal end portions of a pair of guide bars 32 are fixed by fastening screws 45. The distal ends of these guide bars 32 are slidably engaged with a pair of guide holes 31. A pair of guide holes 31 are formed in the slide block 24 along opposing direction to the end block 15 and the holder block 22 in parallel relationship to each other. On these guide bars 32, compression coil springs 33 for biasing the slide block 24 toward the end block 15 are wound around. The compression coil spring 33 is arranged between the slide block 24 and the guide bar holder 25.

Accordingly, the slide block 24 is biased toward the end block 15 by the compression coil springs 33. Namely, the slide block 24 can move toward the guide bar holder 25 against the spring force of the compression coil spring 33.

The side of the slide block 24 opposing the end block 15 is projected right above the pressure drum 43. On this side of the slide block 24 opposing to the end block 15, a holing roller 46 serving as a first contact portion of the present invention is projectingly provided. The holding roller 46 is engageable with the front door sash portion 17 together with a pair of positioning roller 44. With this holding roller 46 and the positioning rollers 44, the main body 26 is engaged with the front door sash portion 17. Then, the pressure drum 43 is pushed upon a flat tape applying surface 42 of the front door sash portion 17. Also, on the upper end of the slide block 24, a finger grip portion 35 is projected. The finger grip portion 35 is useful for retracting the slide block 24 toward the guide bar holder 25 against the spring force of the compression coil springs 33.

At the center portion of back side of the slide block 24, a guide groove 47 extending along the opposing direction of the end block 15 and the holder 22, is formed. In the guide groove 47, a stepped shaft 48 is disposed in sliceable fashion. The stepped shaft 48 is fixed to the slide block 24 at the side opposing to the guide bar holder 25 by means of fastening screws 50 via a connecting plate 49. The stepped shaft 48 has a larger diameter portion 51 having the proximal end fixed to the connecting plate 49 by the screws 50, a smaller diameter portion 52 located at the distal end portion thereof, and a tapered portion 53 connecting these larger diameter portion 51 and the smaller diameter portion 52. The axis of the stepped shaft is set in parallel to the opposing direction of the end block 15 and the holder block 22.

On the center portion of the back side of the end block 15, a stationary groove 54 extending in opposing direction of the end holder 15 and the holder block 22 is formed. In the stationary block 54, the proximal end portion of a supporting pin 55 is secured. The supporting pin 55 is held at the back side of the end block 15 by means of fastening screw 57 via a fastening plate 56. The support pin 55 is set coaxially with the stepped shaft 48. The distal end of the supporting pin 55 is slidably engaged with a pin receptacle hole 58 formed from the distal end face of the stepped shaft 48. Namely, the distal end of the stepped shaft 48 is supported by means of the supporting pin 55.

Figure 13:
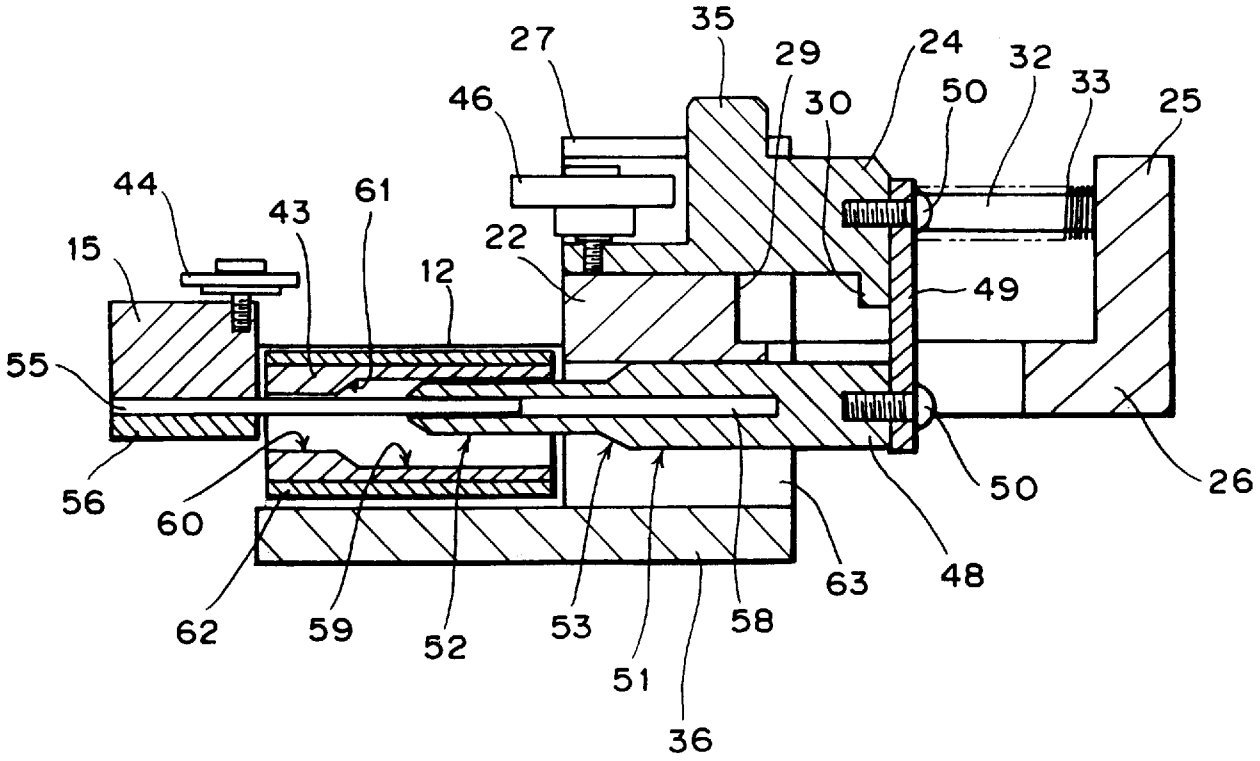
FIG. 13 is a section corresponding to FIG. 11 but showing a condition where a slide block is operated.

The pressure drum 43 has a larger diameter bore portion 59 opposing to the stepped shaft 48, a smaller diameter bore 60 and a tapered bore portion 61. Then, the pressure drum 43 is rotatably supported on the stepped shaft 48. An engaging length (contact length in the lateral direction in FIG. 11) between the larger diameter bore portion 59 of the pressure drum 43 and the larger diameter portion 51 of the stepped shaft 48 and engagement length between the smaller diameter bore portion 60 of the pressure drum 43 and the smaller diameter portion 52 of the stepped shaft 48 are set to be equal to each other. Accordingly, when the slide block 24 is retracted toward the guide bar holder 25 for a predetermined distance from the condition shown in FIG. 11 where the stepped portion 29 of the holder block 22 is in contact with the stopper portion 30, these engaging positions are shifted so that the smaller bore portion 60 of the pressure drum 43 comes into contact with the supporting pin 55 by the own weight of the pressure drum. Then, the larger diameter bore 59 comes into contact with the smaller diameter portion 52 of the stepped shaft 48. Thus, as shown in FIG. 13, the pressure drum 43 is placed in floating condition relative to the supporting pin 55 and the stepped shaft 48.

Figure 11:
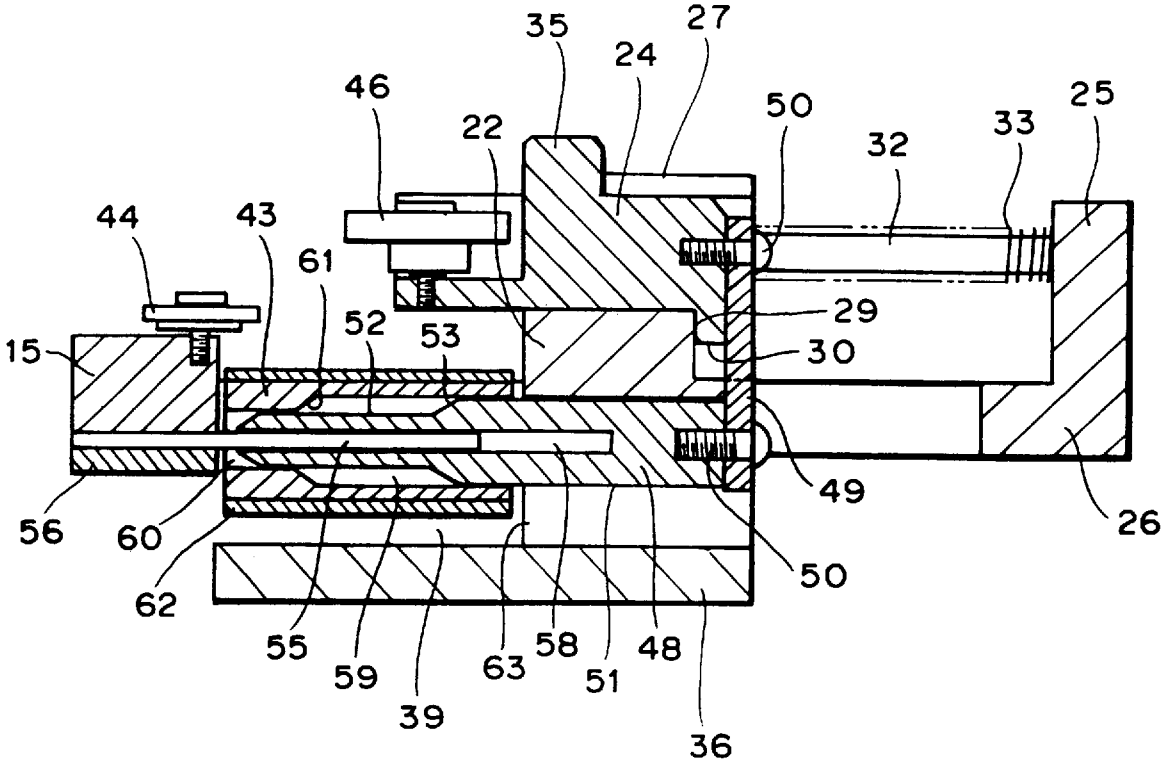
FIG. 11 is a section taken along line XI—XI of FIG. 10.

It should be noted that the engaging length of the larger diameter bore portion 59 of the pressure drum 43 and the larger diameter portion 51 of the stepped shaft 48 in the condition shown in FIG. 11 has to be set appropriately depending upon the width of the front door sash portion 17, on which the shown tape application device is to be used. Similarly, the engaging length between the smaller diameter bore portion 60 of the pressure drum 43 and the smaller diameter portion 52 of the stepped shaft 48 has to be set appropriately depending upon the width of the front door sash portion 17, on which the shown tape application device is to be used. Also, the surface of the pressure drum 43 has to be covered with a rubber-like elastic body, such as a foamed polyurethane, hard rubber and the like, which can be deformed in radial direction.

In the shown embodiment, a difference of the diameters of the larger diameter portion 51 and the smaller diameter portion 52 of the stepped shaft 48 is set to be equal to a difference of the diameter of the smaller diameter portion 52 and the diameter of the supporting pin 55. Hereby, when the slide block 24 is retracted from the position shown in FIG. 11 to the retracted position shown in FIG. 13, the pressure drum 43 can be shifted toward the gripping portion 36 with maintaining parallelism of the axis thereof.

At the center portion of the holder block 22, the proximal end portion of the gripping member 36 is fixed by means of fastening screws 64 via a pair of brackets 63. The gripping member 36 extends along the opposing direction of the end block 15 and the holder block 22 to project right below the pressure drum 43. Then, the gripping member 36 defines a clearance together with the pressure drum 43.

Upon applying operation, at first, the distal end portion of the adhesive tape 13 is peeled from the released paper 41. Then, the distal end of the adhesive tape 13 is applied to the predetermined position (generally, application start position) of the flat tape applying surface). Next, utilizing the finger grip portion 35, the slide block 24 is moved away from the end block 15. With maintaining this condition, the main body 26 is pressed onto the front door sash portion 17 so that the holder block 22 of the main body 26 is placed to overlap with the portion of the tape applying surface 42 where the distal end portion of the adhesive tape 13 is affixed. Then, by releasing the finger from the finger grip portion 35, the positioning roller 44 and the holding roller 46 are engaged to the front door sash portion 17 by the spring force of the compression coil spring 33.

Hereby, the pressure drum 43 is pushed up toward the tape applying surface 42. By further upward movement, the pressure drum 43 contacts with the tape applying surface and causes elastic deformation in such a manner than the rubber-like elastic body 62 on the surface thereof is pressed. Thus, the adhesive tape 13 is in pressed condition onto the tape applying surface 42. Also, when the slide block 24 is forced away from the end block 15, the distance between the pressure drum 43 and the roller is increased. Therefore, attaching and detaching the tape application device to and from the front door sash portion 1*y* can be facilitated.

Figure 14:
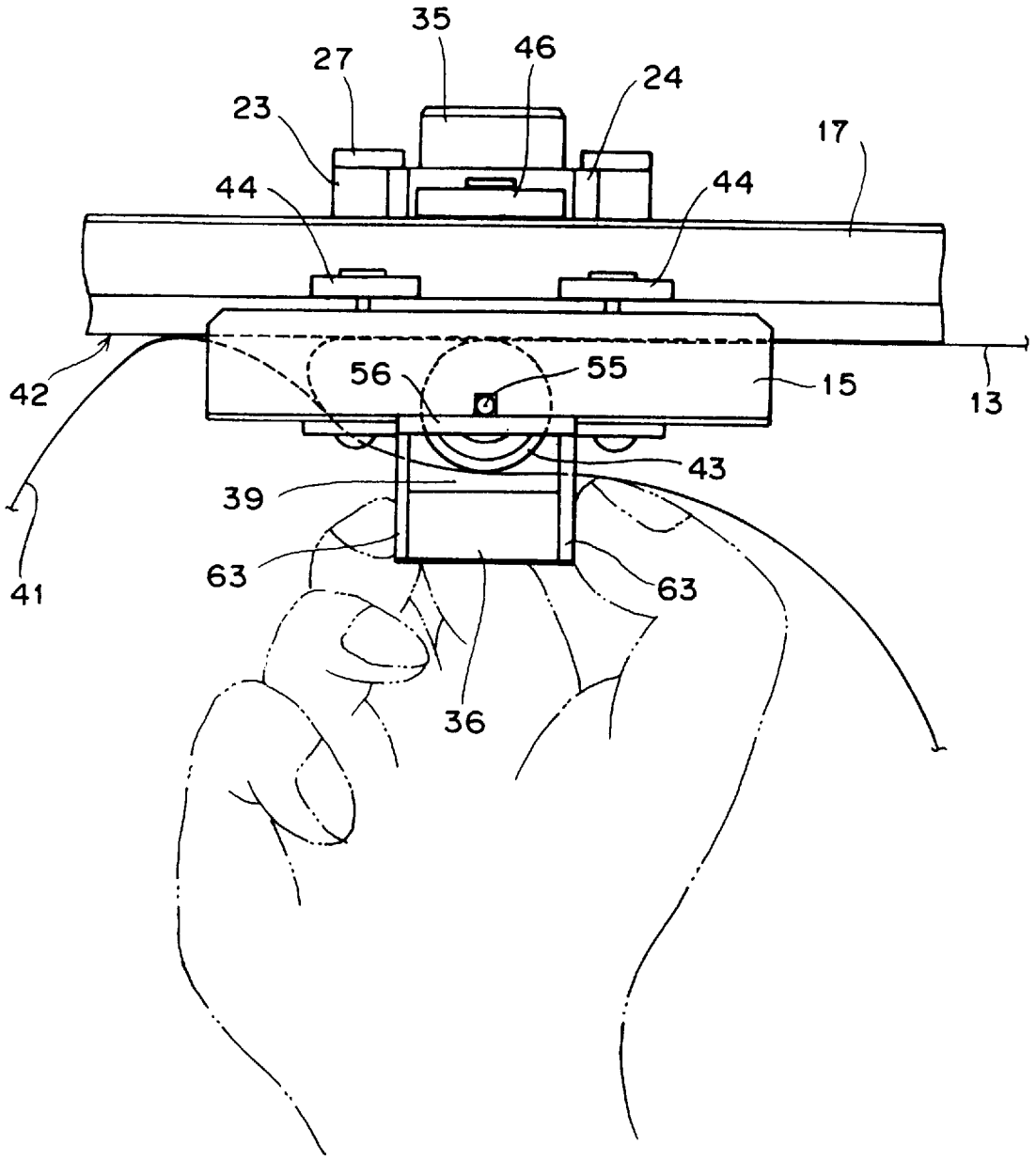
FIG. 14 is a front elevation of the embodiment of the tape application device shown in FIG. 8, in which the tape application device is coupled with the front door sash portion.
Figure 15:
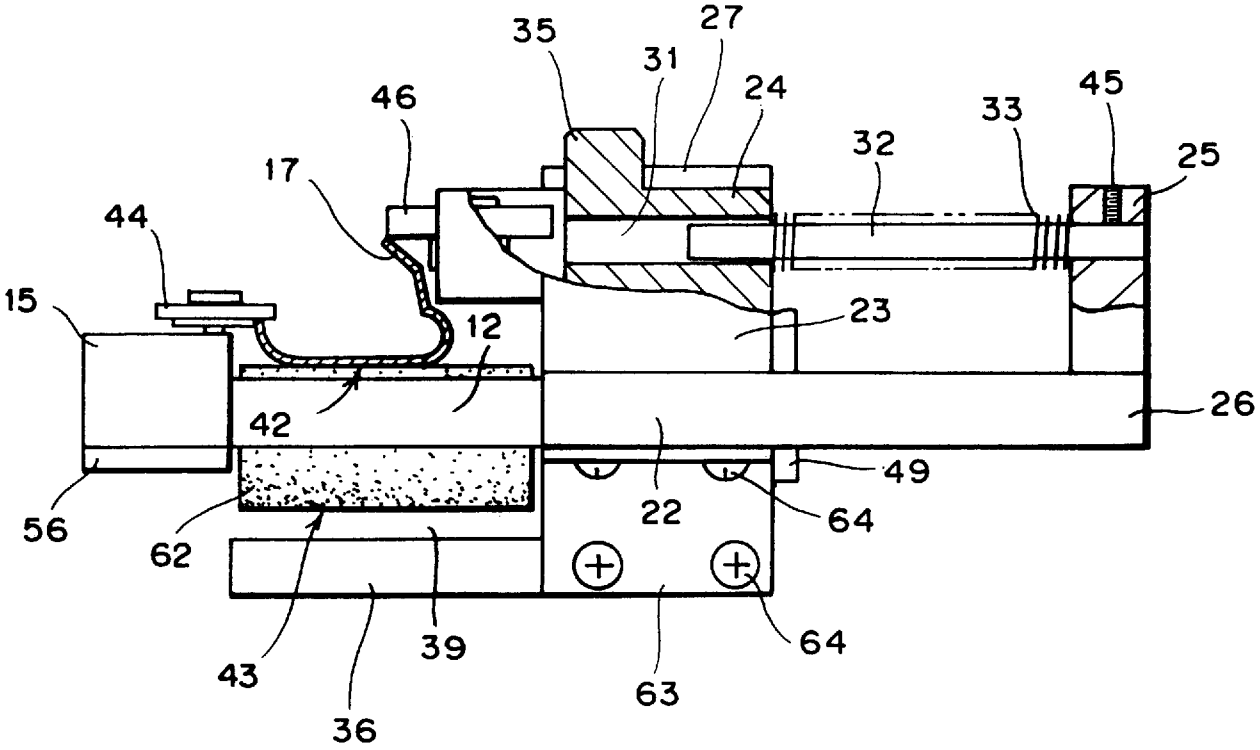
FIG. 15 is a left side elevation of the embodiment of the tape application device shown in FIG. 8, in which the tape application device is coupled with the front door sash portion.

From this condition, the main body 36 is moved toward left in FIG. 14 along the tape applying surface, with peeling off the base strippable sheet. The tape guide portion 12 restricts offset of the adhesive tape 13 in the lateral direction relative to the tape applying surface 42. Then, the adhesive tape 13 is pressed onto the tape applying surface 42 with elastic deformation of the pressure drum 43. Thus, the adhesive tape 13 can be affixed onto the tape applying surface with maintaining the condition set forth above.

In this case, since the slide block 24 is constantly biased toward a pair of positioning rollers 44 by the spring force of the compression coil spring 33, the slide block 24 is displaced relative to the positioning roller following to variation of the width or variation of the contour of the front door sash portion 17. As a result, the main body 26 can be engaged to the front door sash portion 17 without play with respect to the positioning rollers 44. On the other hand, since the surface of the tape guide portion 12 is covered with the member 11 having low friction coefficient and the pressure drum 43 is rotatably supported on the stepped shaft 48, frictional resistance upon moving the main body 26 along the tape applying surface 42 can be small. As a result, tape applying operation can be done easily.

Thus, application of the adhesive tape onto the tape applying surface 42 of the front door sash portion 17 is performed. After completion of the tape applying operation, by means of not shown squeezing roller, the both edge portions of the adhesive tape 13 in the width direction are affixed onto the remaining portion of the front door sash portion 17. The applying operation in this condition can be done without any difficulty since the adhesive tape 13 has already been positioned relative to the front door sash portion 17.

Figure 12:
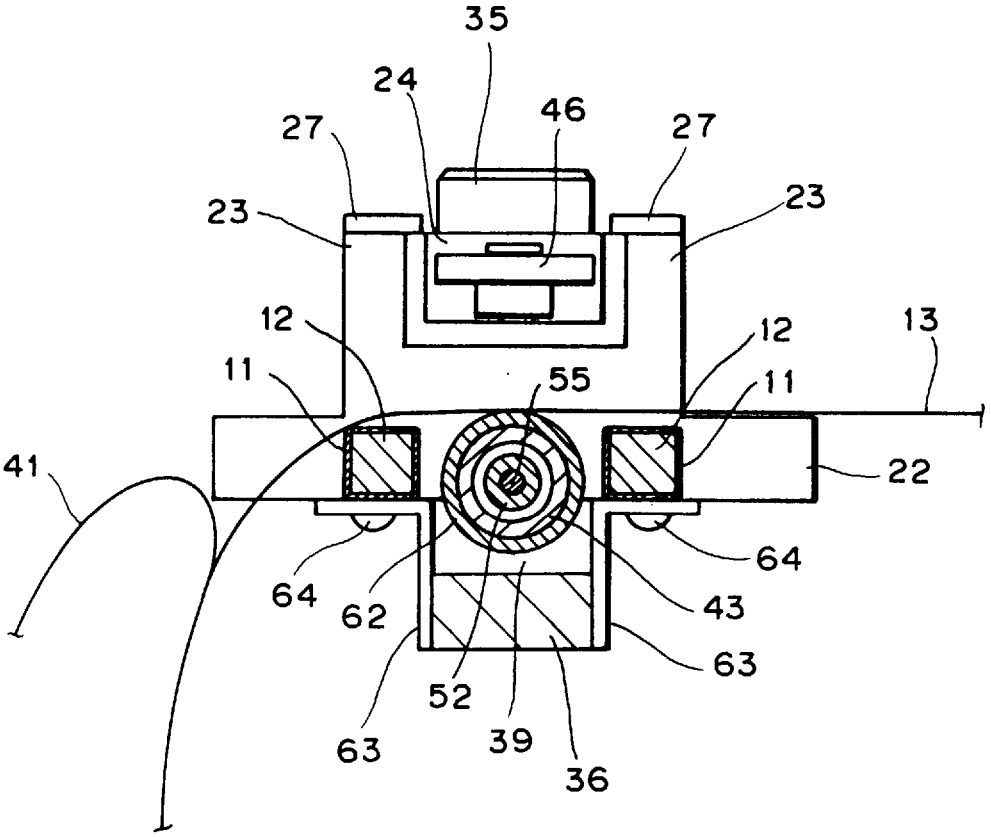
FIG. 12 is a section taken along line XII—XII of FIG. 10.

It is possible to place the adhesive tape 13 and the released paper 41 at the front side of the traveling direction as shown in FIG. 12. In this case, the adhesive tape 13 and the released paper 41 are passed through a clearance 39 between the gripping portion 36 and the tape guide portion 12. Then, the adhesive tape 13 is turned over the tape guide portion 12. Hereby, only the released paper 41 can be placed at the front side of the traveling direction of the main body. As a result, it is possible to enhance the efficiency of the tape applying operation.

On the other hand, the front door sash portion 17 is normally symmetric in left and rights of the vehicular body. Therefore, depending upon left- and right-cut, the direction to pass the adhesive tape 13 relative to the tape guide portion 12 is reversed from the condition shown in FIGS. 12 and 14, and the main body 26 is moved in the reverse direction relative to the front door sash portion 17. Thus, the shown embodiment of the tape application device can be adapted for left and right front door sash portions 17 without requiring any modifications.

Furthermore, when the width and configuration of the front door sash portion 17 are differentiated significantly depending upon kind of the vehicle, the shown embodiment of the tape application device can be adapted or adjusted by exchanging the positioning rollers 44 and the holding roller 46 with those having different size and/or configuration.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims. For instance, while shown embodiment employs the cylindrical pressure drum 43 in the pressing portion, a flat plate form pressure member may also applicable. Also, in the shown embodiment, as projecting and retracting means for the pressure drum 43, the stepped shaft 48 and the corresponding stepped bore are employed. However, any other construction with permits the pressure drum 43 to be projected and retracted associated with sliding operation of the sliding block can be employed.

What is claimed is:

1. A tape application device for applying an adhesive tape on a tape applying surface formed on a work, comprising:

a main body having a gripping portion;

a tape guide portion provided in said main body and having a pressing portion for pressing said adhesive tape onto said tape applying surface; and engaging means for slidably pressing said pressing portion onto said tape applying surface, said engaging means including:

first engaging portion having a sliding block held slidably with respect to a holder block provided in said main body, and a first contact portion provided in said sliding block and releasably contacting with said work; and second engaging portion provided on said main body in opposition to said first engaging portion across said tape guide portion and having a second engaging portion with a second contact portion contacting with said work.

2. A tape application device as claimed in claim 1, wherein a plurality of said second contact portions are arranged with a given interval along a guiding direction of said adhesive tape by said tape guide portion.

3. A tape application device as claimed in claim 1, wherein said second contact portion is a claw member supported on said main body, and said second contact portion further comprises position adjusting means for adjusting position of said second contact portion in opposing direction to said first contact portion.

4. A tape application device as claimed in claim 1, wherein said pressing portion is formed in projecting condition at least at a center portion of said tape guide portion, in elastically deformable fashion.

5. A tape application device as claimed in claim 1, wherein said slide block is slidable in opposing direction of said first engaging portion and said second engaging portion.

6. A tape application device as claimed in claim 5, wherein biasing means for biasing said first engaging portion toward said second engaging portion is provided between said main body and said slide block.

7. A tape application device as claimed in claim 1, wherein the surface of said pressing portion is coated with a member having low friction coefficient.

8. A tape application device as claimed in claim 1, wherein said gripping portion extends in a direction perpendicular to a guiding direction of said adhesive tape by said tape guide portion with a clearance relative to said pressing portion.

9. A tape application device as claimed in claim 8, wherein said adhesive tape and said released paper before peeling passes through a clearance defined between said gripping portion and said tape guide portion.

10. A tape application device for applying an adhesive tape on a tape applying surface formed on a work, comprising:

a main body having a gripping portion;

a tape guide portion provided in said main body and having a pressing portion for pressing said adhesive tape onto said tape applying surface;

engaging means for slidably pressing said pressing portion onto said tape applying surface; and projecting and retracting means for projecting and retracting said pressing portion along pressing direction;

said engaging means including first engaging portion having a sliding block held slidably with respect to a holder block provided in said main body, and a first contact portion provided in said sliding block and releasably contacting with said work; and second engaging portion provided on said main body in opposition to said first engaging portion across said tape guide portion and having a second engaging portion with a second contact portion contacting with said work.

11. A tape application device as claimed in claim 10, wherein said first contact portion is a roller rotatably supported on said slide block and said second contact portion is a roller rotatably support on said main body.

12. A tape application device as claimed in claim 10, wherein a plurality of said second contact portions are arranged with a given interval along a guiding direction of said adhesive tape by said tape guide portion.

13. A tape application device as claimed in claim 10, wherein said pressing portion has a surface formed with a rubber-like elastic body.

14. A tape application device as claimed in claim 10, wherein said slide block is slidable in opposing direction of said first engaging portion and said second engaging portion.

15. A tape application device as claimed in claim 14, wherein biasing means for biasing said first engaging portion toward said second engaging portion is provided between said main body and said slide block.

16. A tape application device as claimed in claim 10, wherein said projecting and retracting means is associated with said sliding block for operation according to sliding operation of the latter.

17. A tape application device as claimed in claim 16, wherein said projecting and retracting means includes a stepped shaft having a larger diameter portion at a proximal end portion connected to said slide block and a smaller diameter portion at a distal end portion connected to said larger diameter portion via a tapered position, and a holding pin arranged coaxially with said stepped shaft and supported on said main body at a proximal end thereof, said distal end of said support pin is slidably engaged with said stepped shaft from said smaller diameter portion side, and said pressing portion has a stepped bore corresponding to said stepped shaft and is rotatably supported on said stepped shaft.

18. A tape application device as claimed in claim 17, wherein a difference of diameters between said larger diameter portion and said smaller diameter portion of said stepped shaft and a difference of diameters between said smaller diameter portion of said stepped shaft and said support pin are set substantially equal to each other.

19. A tape application device as claimed in claim 10, wherein said gripping portion extends in a direction perpendicular to a guiding direction of said adhesive tape by said tape guide portion with a clearance relative to said pressing portion.

20. A tape application device as claimed in claim 19, wherein said adhesive tape and the released paper before peeling pass through a clearance between said gripping portion and said tape guide portion.

* * * * *

UNITED STATES PATENT AND TRADEMARK OFFICE

CERTIFICATE OF CORRECTION

PATENT NO. : 5,820,725

DATED : October 13, 1998

INVENTOR(S) : Tsuyoshi MAEDA et al.

It is certified that error appears in the above-indentified patent and that said Letters Patent is hereby corrected as shown below:

Claim 11, Column 14, line 60, "support" should read --supported--.

Signed and Sealed this

Twentieth Day of July, 1999

*Attest:*

*Attesting Officer*

Q. TODD DICKINSON

*Acting Commissioner of Patents and Trademarks*

US005820725C1

(12) EX PARTE REEXAMINATION CERTIFICATE (5813th)

United States Patent

Maeda et al.

(10) Number: US 5,820,725 C1

(45) Certificate Issued: Jul. 17, 2007

(54) TAPE APPLICATION DEVICE

(75) Inventors: Tsuyoshi Maeda, Tokyo (JP); Sigeyuki Yaguchi, Saitama (JP)

(73) Assignees: Lintec Corporation, Tokyo (JP); Honda Motor Co., Ltd., Tokyo (JP)

Reexamination Request:
No. 90/007,579, Jun. 9, 2005

Reexamination Certificate for:

| | |
|---|---|
| Patent No.: | **5,820,725** |
| Issued: | **Oct. 13, 1998** |
| Appl. No.: | **08/826,754** |
| Filed: | **Mar. 24, 1997** |

Certificate of Correction issued Jul. 20, 1999.

Related U.S. Application Data

(63) Continuation-in-part of application No. 08/694,338, filed on Aug. 8, 1996, now abandoned.

(30) Foreign Application Priority Data

Aug. 11, 1995 (JP) ..... 7-205882
Dec. 18, 1996 (JP) ..... 8-338232

(51) Int. Cl.
*B65H 35/00* (2006.01)
*B65H 37/04* (2006.01)

(52) U.S. Cl. ..... 156/391; 156/523; 156/540; 156/579

(58) Field of Classification Search ..... None
See application file for complete search history.

(56) References Cited

U.S. PATENT DOCUMENTS

| | | | |
|---|---|---|---|
| 3,969,180 | A | 7/1976 | Ravesloot |
| 4,174,246 | A | 11/1979 | Ralston |
| 4,253,905 | A | 3/1981 | Regan |
| 4,285,752 | A | 8/1981 | Higgins |
| 4,574,030 | A | 3/1986 | Pilcher |
| 4,581,091 | A | 4/1986 | Lane |
| 4,608,116 | A | 8/1986 | Braselton |
| 4,623,421 | A | 11/1986 | Cardin |
| 4,729,810 | A | 3/1988 | Brooks |
| 4,804,437 | A | 2/1989 | Tirtoprodjo et al. |

(Continued)

FOREIGN PATENT DOCUMENTS

| | | |
|---|---|---|
| JP | 04-277162 | 10/1992 |
| JP | 07-242364 | 9/1995 |
| JP | 08-059059 | 3/1996 |
| WO | WO 96/05107 | 2/1996 |

OTHER PUBLICATIONS

Machine Translation of JP 07–242364 A obtained from http://www.ipdl.ncipi.go.jp/homepg_e.ipdl.*
Official Action in Japanese Application No. 07–205882.
Official Action in Japanese Application No. 08–338232.
Tracker Technologies, Inc. Letter of July 20, 2005.

*Primary Examiner*—Stephen Stein

(57) ABSTRACT

A tape application device according to the present invention is designed for applying an adhesive tape on a tape applying surface formed on a work. The tape application device includes a main body having a gripping portion, a tape guide portion provided in the main body and having a pressing portion for pressing the adhesive tape onto the tape applying surface, and engaging means for slidably pressing the pressing portion onto the tape applying surface. The engaging means includes first engaging portion having a sliding block held slidably with respect to a holder block provided in the main body, and a first contact portion provided in the sliding block and releasably contacting with the work and second engaging portion provided on the main body in opposition to the first engaging portion across the tape guide portion and having a second engaging portion with a second contact portion contacting with the work. The tape application device can apply the adhesive tape at a predetermined position of the left and right door sash portions, and also the applying operation can be done easily and quickly.

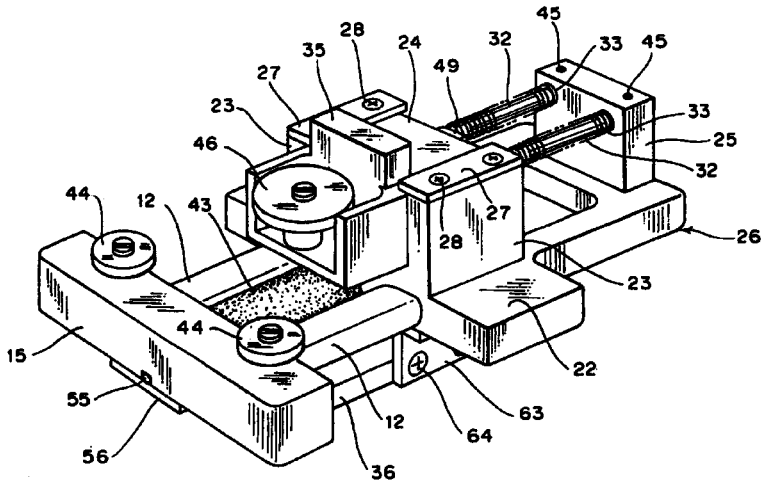

U.S. PATENT DOCUMENTS

| | | | |
|---|---|---|---|
| 4,818,329 | A | 4/1989 | Tutas et al. |
| 4,824,516 | A | 4/1989 | Ishihara et al. |
| 4,826,562 | A | 5/1989 | Ehlis |
| 5,068,004 | A | 11/1991 | Moll |
| 5,076,883 | A | 12/1991 | Bosley |
| 5,171,397 | A | 12/1992 | Arnold |
| 5,174,850 | A | 12/1992 | Stefan |
| 5,178,717 | A | 1/1993 | Rodriguez |
| 5,181,983 | A | 1/1993 | Sakai |
| 5,192,385 | A | 3/1993 | Moll |
| 5,316,614 | A | 5/1994 | Phillips |
| 5,380,395 | A | 1/1995 | Uchida |
| 5,393,368 | A | 2/1995 | Stevens |
| 5,462,633 | A | 10/1995 | Manusch et al. |
| 5,472,560 | A | 12/1995 | Horng |
| 5,595,626 | A | 1/1997 | Yokouchi et al. |

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 10, 12, 13, 16, 19 and 20 is confirmed.

Claims 5 and 6 are cancelled.

Claims 1, 11, 14, 15 and 17 are determined to be patentable as amended.

Claims 2–4, 7–9 and 18, dependent on an amended claim, are determined to be patentable.

1. A tape application device for applying an adhesive tape on a tape applying surface formed on a work, comprising:

a main body having a gripping portion;

a tape guide portion provided in said main body and having a pressing portion for pressing said adhesive tape onto said tape applying surface; and engaging means for slidably pressing said pressing portion onto said tape applying surface, said engaging means including:

first engaging portion having a sliding block held slidably with respect to a holder block provided in said main body, and a first contact portion provided in said sliding block and releasably contacting with said work; and second engaging portion provided on said main body in opposition to said first engaging portion across said tape guide portion and having a second engaging portion with a second contact portion contacting with said work,

*wherein said first engaging portion of said sliding block is slidable toward said second engaging portion, and biasing means for biasing said first engaging portion toward said second engaging portion is provided between said main body and said sliding block.*

11. A tape application device as claimed in claim 10, wherein said first contact portion is a roller rotatably supported on said [slide block] *sliding block* and said second contact portion is a roller rotatably supported on said main body.

14. A tape application device as claimed in claim 10, wherein *said first engaging portion of said sliding block* [said slide block] is slidable [in opposing direction of said first engaging portion and] *toward* said second engaging portion.

15. A tape application device as claimed in claim 14, wherein biasing means for biasing said first engaging portion toward said second engaging portion is provided between said main body and said [slide block ] *sliding block*.

17. A tape application device as claimed in claim 16, wherein said projecting and retracting means includes a stepped shaft having a larger diameter portion at a proximal end portion connected to said [slide block] *sliding block* and a smaller diameter portion at a distal end portion connected to said larger diameter portion via a tapered position, and a holding pin arranged coaxially with said stepped shaft and supported on said main body at a proximal end thereof, said distal end of said support pin is slidably engaged with said stepped shaft from said smaller diameter portion side, and said pressing portion has a stepped bore corresponding to said stepped shaft and is rotatably supported on said stepped shaft.

* * * * *